US006982385B2

(12) United States Patent
Wu

(10) Patent No.: US 6,982,385 B2
(45) Date of Patent: Jan. 3, 2006

(54) WIRE CABLE OF ELECTRICAL CONDUCTOR FORMING OF MULTIPLE METALS OR ALLOYS

(76) Inventor: Jeng-Shyong Wu, No. 14, Alley 1, Lane 326, Shyr-Piin Road, Hsin-Chu City (TW)

( * ) Notice: Subject to any disclaimer, the term of this patent is extended or adjusted under 35 U.S.C. 154(b) by 0 days.

(21) Appl. No.: 10/728,350

(22) Filed: Dec. 4, 2003

(65) Prior Publication Data

US 2005/0121223 A1 Jun. 9, 2005

(51) Int. Cl.
*H01B 5/00* (2006.01)

(52) U.S. Cl. ..... 174/126.1; 174/128.1; 174/128.2

(58) Field of Classification Search ..... 174/126.1, 174/126.2, 128.1, 128.2, 113 R
See application file for complete search history.

(56) References Cited

U.S. PATENT DOCUMENTS

| | | | | |
|---|---|---|---|---|
| 723,717 A | | 3/1903 | Nicholson | |
| 3,264,404 A | * | 8/1966 | Trebby et al. | 174/130 |
| 3,428,926 A | * | 2/1969 | Bogner et al. | 335/216 |
| 3,676,576 A | * | 7/1972 | Dubernet et al. | 174/113 R |
| 4,449,012 A | * | 5/1984 | Voser | 174/70 A |
| 5,296,648 A | * | 3/1994 | Johnson | 174/117 F |
| 6,498,300 B2 | * | 12/2002 | Flick | 174/110 R |

FOREIGN PATENT DOCUMENTS

| | | | |
|---|---|---|---|
| JP | 02-148513 | * | 6/1990 |
| JP | 5-242735 | * | 9/1993 |

* cited by examiner

*Primary Examiner*—Chau N. Nguyen
(74) *Attorney, Agent, or Firm*—McGlew and Tuttle, P.C.

(57) ABSTRACT

A wire cable of electrical conductor forming of multiple metals or alloys includes single (bundle) wire cable or double (bundle) wire cables, in which at least in one bundle of electrical conductor, each bundle of electrical conductor is composed of slim electric wire made by two or more than two metals or alloys, which is covered by insulator to form a wire cable of electrical conductor.

22 Claims, 12 Drawing Sheets

6A

6B

6C

6D

WIRE CABLE OF ELECTRICAL CONDUCTOR FORMING OF MULTIPLE METALS OR ALLOYS

FIELD OF INVENTION

The present invention relates to a wire cable of electrical conductor forming of multiple metals or alloys. Especially, it relates to a wire cable of electrical conductor forming of multiple metals or alloys including single (bundle) wire cable or double (bundle) wire cable, in which at least in one bundle of electrical conductor, each bundle of electrical conductor is composed of slim electric wire made by two or more than two metals or alloys, which is covered by insulator to form a wire cable of electrical conductor. Thus, the safety is extremely good.

BACKGROUND OF INVENTION

According to the description in U.S. Pat. No. 728,717, it discloses "A compound electrical conductor composed of a core and a shell of different metals drawn into wire, one metal being aluminum and the other copper."

The purpose of the present invention is to provide a wire cable of electrical conductor forming of multiple metals or alloys. Said wire cable includes single (bundle) wire cable or double (bundle) wire cables, in which at least in one bundle of electrical conductor, each bundle of electrical conductor is composed of slim electric wire made by two or more than two metals or alloys, which is covered by insulator to form a wire cable of electrical conductor.

According to the present invention, A or B represents a single metal or alloy, and AB represents two kinds of metals or alloys, such as: copper-clad aluminum, copper-clad steel, copper-clad alloy, etc. A wire cable of electrical conductor forming of multiple metals or alloys includes single (bundle) wire cable or double (bundle) wire cables, in which at least in one bundle of electrical conductor, each bundle of electrical conductor is composed of slim electric wire made by two or more than two metals or alloys, and one metal or alloy is contained within another metal or alloy. Further, said electrical conductor is covered with insulator to form a wire cable.

A wire cable of electrical conductor forming of multiple metals or alloys is to use several slim wires (electrical conductor) to be parallel and winding to form a bundle. It also to use several single wire cable to be wound into large wire cable, then to add insulator. It is able to use each bundle wire cable mutually and once to be covered by insulator and to press out to form altogether wire cable.

The further purpose of the present invention is to provide a wire cable of electrical conductor forming of multiple metals or alloys. Said wire cable includes single (bundle) wire cable or double (bundle) wire cables, in which at least in two bundle of electrical conductor, one bundle of said electrical conductors is composed of slim electric wire made by two or more than two metals or alloys. Another bundle of said electrical conductors is composed of slim electric wire made by multiple wires of single metal or alloy, which is covered by insulator to form a wire cable of electrical conductor.

The further purpose of the present invention is to provide a wire cable of electrical conductor forming of multiple metals or alloys. Said wire cable includes multiple (bundle) wire cables, in which at least in one bundle of electrical conductor, each bundle of electrical conductor is composed of slim electric wire made by two or more than two metals or alloys and at least slim electric wire made by single metal or alloy, which is covered by insulator to form a wire cable of electrical conductor.

The further purpose of the present invention is to provide a wire cable of electrical conductor forming of multiple metals or alloys. Said wire cable includes single (bundle) wire cable or double (bundle) wire cables, in which at least in two bundles of electrical conductors, one bundle of said electrical conductors is composed of slim electric wires made by two or more than two metals or alloys and at least one slim electric wire made by single metal or alloy. Another bundle of said electrical conductors is composed of slim electric wire made by multiple wires of single metal or alloy, which is covered by insulator to form a wire cable of electrical conductor.

The other purpose of the present invention is to provide a wire cable of electrical conductor forming of multiple metals or alloys. Said wire cable includes two (bundle) wire cables or more that two (bundle) wire cables, in which at least in two bundle of electrical conductors, one bundle of said electrical conductors is composed of slim electric wire made by two or more than two metals or alloys. Another bundle of said electrical conductors is composed of slim electric wire made by two or more than two metals or alloys and at least one slim electric wire made by single metal or alloy, which is covered by insulator to form a wire cable of electrical conductor.

The other further purpose of the present invention is to provide a wire cable of electrical conductor forming of multiple metals or alloys. Said wire cable includes three kinds of single (bundle) wire cables or more than three (bundle) wire cables, in which at least in three bundles of electrical conductors, one bundle of said electrical conductors is composed of slim electric wire made by two or more than two metals or alloys and at least one slim electric wire made by single metal or alloy to form one bundle. Another bundle of said electrical conductors is composed of slim electric wire made by single metal or alloy, which is covered by insulator to form a wire cable of electrical conductor.

Other objects, effects and features will become apparent when the description of preferred embodiments is taken in conjunction with the annexed drawings.

BRIEF DESCRIPTION OF THE DRAWINGS

FIGS. 1A and 1C are cross sectional views of FIGS. 1B and 1D respectively. FIG. 1B is a cross sectional view along with the wire cable and the electrical conductors are linear order. FIG. 1D is a cross sectional view along with the wire cable and the electrical conductors are winding order.

FIGS. 2A and 2C are cross sectional views of FIGS. 2B and 2D respectively. FIG. 2B is a cross sectional view along with the wire cable and the electrical conductors are linear order. FIG. 2D is a cross sectional view along with the wire cable and the electrical conductors are winding order.

FIGS. 3A and 3C are cross sectional views of FIGS. 3B and 3D respectively. FIG. 3B is a perspective view of two bundles of wire cable in winding. FIG. 3D is a cross sectional view along with the wire cable and the two bundle wire cables are linear order but the electrical conductors are winding order.

FIGS. 4A and 4C are cross sectional views of FIGS. 4B and 4D respectively. FIG. 4B is a perspective view of two bundles of wire cable in linear order and the electrical conductors are also linear order. FIG. 4D is a cross sectional view along with the wire cable and the two wire cables are winding order.

FIG. 5B is a cross sectional view of double wire cables in linear order but the electrical conductors are winding order. FIG. 5D is a cross sectional view of double (twin) bundle wire cables along with the wire cable but the electrical conductors are winding order. FIGS. 5A and 5C are cross sectional views of FIGS. 5B and 5D respectively.

FIGS. 6A and 6C are cross sectional views of FIGS. 6B and 6D respectively. FIG. 6B is a perspective view of single (bundle) wire cable in linear order and the electrical conductors are also linear order. FIG. 6D is a cross sectional view along with the wire cable and the electrical conductors are winding order.

FIG. 7A is a cross sectional view of single metal of electrical conductor of the prior art. FIG. 7B is a cross sectional view of electrical conductor forming of multiple metals or alloys of the present invention. FIG. 7C is a cross sectional view of electrical conductor forming of a single metal and multiple alloys. FIGS. 7D, 7E, 7F, 7G and 7H are two bundle wire cables of electrical conductor forming of multiple metals or alloys and are the cross sectional views of electrical conductors forming of various patterns.

FIGS. 8A, 8B, 8C, 8D and 8E are cross sectional views of double wire cables. FIGS. 8F, 8G, 8H, 8I and 8J are cross sectional views of two (separate) bundle wire cables with insulator cover.

FIGS. 9A, 9B, 9C, 9D and 9E are cross sectional views of three bundle wire cables. FIGS. 9F, 9G, 9H, 9I and 9J are cross sectional views of three (separate) bundle wire cables.

FIGS. 10A, 10B, 10C, 10D, 10E, 10F, 10G, 10H and 10I are cross sectional views of three (separate) bundle wire cables with insulator cover and are the cross sectional views of electrical conductors forming of various patterns.

FIGS. 11A, 11B, 11C, 11D, 11E, 11F, 11G, 11H and 11I are cross sectional views of three (combined) bundle wire cables to form triangle order and are the cross sectional views of electrical conductors forming of various patterns.

FIGS. 12A, 12B, 12C, 12D, 12E, 12F, 12G, 12H and 12I are cross sectional views of three (combined) bundle wire cables to form a linear order and are the cross sectional views of electrical conductors forming of various patterns.

Now referring to FIGS. 1, 1A–1D, these drawings show a wire cable of electrical conductor forming of multiple metals or alloys of the present invention. FIG. 1B is a horizontally cross sectional view of single wire cable of electrical conductor 1 along with wire cable. An insulator 11 of cable covers electrical conductor 12, and said electrical conductor 12 is forming a bundle along with the cable to form a linear order horizontally. FIG. 1A is a cross sectional view of FIG. 1B, an insulator 11 covers electrical conductor 12 and said electrical conductor 12 is composed of two kind of metals or alloys 13. FIG. 1D is also a horizontally cross sectional view of single wire cable of electrical conductor along with wire cable. An insulator of cable covers winding electrical conductor 14. FIG. 1C is a cross sectional view of FIG. 1D.

FIGS. 2, 2A–2D are perspective views showing another type of wire cable of electrical conductor forming of multiple metals or alloys of the present invention. FIG. 2B is a horizontally cross sectional view of double (twin) bundle wire cables of electrical conductor 2 along with wire-cable. An insulator 21 of cable covers electrical conductor 22, and said electrical conductor 22 is composed of two kinds of metal or alloys 23. FIG. 2D is also a horizontally cross sectional view of double (twin) bundle wire cables of electrical conductor along with wire cable. An insulator of cable covers the electrical conductor 24. FIG. 2C is a cross sectional view of FIG. 2D.

FIGS. 3, 3A–3D are perspective views showing the other type of wire cable of electrical conductor forming of multiple metals or alloys of the present invention. FIG. 3B is a horizontally cross sectional view of two (separate) bundle wire cables of electrical conductor in winding. An insulator 31 of cable covers electrical conductor 32, and said electrical conductor 32 is forming a bundle along with the cable to form a linear or winding order horizontally. FIG. 3A is a horizontally cross sectional view of FIG. 3B. An insulator 31 of cable covers electrical conductor 32, and said electrical conductor 32 is composed of two kinds of metals or alloys 33. FIG. 3D is also a horizontally cross sectional view of two bundle wire cables of electrical conductors along with wire cable. An insulator of cable covers electrical conductor 34, and said electrical conductor 32 is forming a bundle along with the cable to form a linear or winding order horizontally.

FIGS. 4, 4A–4D are perspective views showing a further type of wire cable of electrical conductor forming of multiple metals or alloys of the present invention. FIG. 4B is a horizontally cross sectional view of two bundle wire cables of electrical conductor. An insulator of cable covers electrical conductor, and said electrical conductor is forming a bundle along with the cable to form a linear order horizontally. FIG. 4A is a horizontally cross sectional view of FIG. 4B. An insulator of cable covers electrical conductor, and in which one electrical conductor is composed of single metal and another electrical conductor is composed of two kinds of metals or alloys 43. FIG. 4D is a perspective view of two bundle wire cables of electrical conductor in winding along with wire cable. An insulator of cable covers electrical conductor, and said electrical conductor is forming a bundle along with the cable to form a linear or winding order horizontally. FIG. 4C is a cross sectional view of FIG. 4D. An insulator of cable covers electrical conductor, in which one electrical conductor is composed of single metal 41 and another electrical conductor is composed of two kinds of metals or alloys 43.

FIGS. 5, 5A–5D are perspective views showing a further type of wire cable of electrical conductor forming of multiple metals or alloys of the present invention. FIG. 5B is a horizontally cross sectional view of double (twin) bundle wire cables 5 of electrical conductor along with the cable. An insulator 51 of cable covers electrical conductor, and said electrical conductor is forming a bundle along with the cable to form a winding order horizontally. FIG. 5A is a cross sectional view of FIG. 5B. An insulator 51 of cable covers electrical conductor, and in which one electrical conductor is composed of single metal 52 and another electrical conductor is composed of two kinds of metals or alloys 53. FIG. 5D is a horizontally cross sectional view of two (separate) bundle wire cables of electrical conductor along with the cable. An insulator of cable covers electrical conductor, and said electrical conductor is forming a bundle along with the cable to form a winding order horizontally. FIG. 5C is a cross sectional view of FIG. 5D. An insulator 51 of cable covers electrical conductor, in which one electrical conductor is composed of single metal 52 and another electrical conductor is composed of two kinds of metals or alloys 53.

FIGS. 6, 6A–6D are perspective views showing a further type of a wire cable of electrical conductor forming of multiple metals or alloys of the present invention. FIG. 6B is a horizontally cross sectional view of single wire cable 6 of electrical conductor along with wire cable. An insulator 61 of cable covers electrical conductor 62, and said electrical conductor 62 is forming a bundle along with the cable to form a linear order horizontally. FIG. 6A is a cross sectional view of FIG. 6B, an insulator covers electrical conductor and said electrical conductor is composed of single metal 63 and another electrical conductor is composed of two kinds of metals or alloys 64. FIG. 6D is identical with those of in FIG. 6B but the electrical conductor being forming a bundle along with wire cable to form a winding order. FIG. 6C is a cross sectional view of FIG. 6D.

FIGS. 7, 7A–7H are cross sectional views showing various types of wire cables of electrical conductors forming of multiple metals or alloys of the present invention. FIG. 7A is a cross sectional view of single metal of electrical conductor of the prior art, in which An insulator 71 covers the electrical conductor and said electrical conductor is forming a bundle and composed of single metal 73. FIG. 7B is a cross sectional view of electrical conductor forming of multiple metals or alloys of the present invention. The electrical conductor is forming a bundle and composed of multiple metals or alloys 74. FIG. 7C is a cross sectional view of electrical conductor forming of a single metal and multiple alloys. The electrical conductor is forming a bundle and composed of a single metal and multiple metals or alloys 74. FIG. 7D is a cross sectional view of two bundle wire cables. The electrical conductor is forming a bundle and composed of multiple metals or alloys. FIG. 7E is a cross sectional view of two bundle wire cables. The electrical conductor is forming a bundle and composed of a single metal and multiple metals or alloys respectively. FIG. 7F is a cross sectional view of two bundle wire cables. One of electrical conductors is composed of multiple metals or alloys and the other electrical conductor is composed of a single metal and multiple metals or alloys. FIG. 7G is a cross sectional view of two bundle wire cables. One of electrical conductors is composed of multiple metals or alloys and the other electrical conductor is composed of a single metal. FIG. 7H is a cross sectional view of two bundle wire cables. One of electrical conductors is composed of a single metal 73 and multiple metals or alloys 74 and the other electrical conductor is composed of a single metal 73.

FIGS. 8, 8A–8J are cross sectional views showing further various types of wire cables of electrical conductors forming of multiple metals or alloys of the present invention, in which FIGS. 8A–8E are cross sectional views of double (twin) bundle wire cables and FIGS. 8F–8J two bundle wire cables with insulator cover. FIG. 8A is a cross sectional view of double bundle wire cables. An insulator 81 of cable envelops the electrical conductor 82 and said electrical conductors are forming a bundle and composed of multiple metals or alloys 84. FIG. 8B is a cross sectional view of double bundle wire cables. An insulator of cable envelops the electrical conductor. Said electrical conductor is forming a bundle and composed of single metal 83 and multiple metals or alloys. FIG. 8C is a cross sectional view of double bundle wire cables, in which one of wire cables of electrical conductor is composed of multiple metals or alloys, and the other electrical conductor is composed of a single metal and multiple metals or alloys. FIG. 8D is a cross sectional view of double bundle wire cables. One of wire cables of electrical conductors is composed of multiple metals or alloys and the other wire cable of electrical conductor is composed of a single metal. FIG. 8E is a cross sectional view of double bundle wire cables. One of wire cables of electrical conductors is composed of a single metal or alloy and the other wire cable of electrical conductor is composed of a single metal. FIG. 8F is cross sectional view of two bundle wire cables with cover and said electrical conductors are forming a bundle and composed of multiple metals or alloys 84. FIG. 8G is a cross sectional view of two bundle wire cables with cover and said electrical conductor is forming a bundle and composed of single metal 83 and multiple metals or alloys. FIG. 8H is a cross sectional view of two bundle wire cables with cover, in which one of wire cables of electrical conductor is composed of multiple metals or alloys, and the other electrical conductor is composed of a single metal and multiple metals or alloys. FIG. 8I is a cross sectional view of two bundle wire cables with cover. One of wire cables of electrical conductors is composed of multiple metals or alloys 84 and the other wire cable of electrical conductor is composed of a single metal 83. FIG. 8J is a cross sectional view of two bundle wire cables with cover. One of wire cables of electrical conductors is composed of a single metal and multiple metals or alloys, and the other wire cable of electrical conductor is composed of a single metal.

FIGS. 9, 9A–9I are cross sectional views showing further various types of wire cables of electrical conductors forming of multiple metals or alloys of the present invention, in which FIGS. 9A–9I are cross sectional views of three (separate) bundle wire cables in triangle order. FIG. 9A is an insulator of cable to envelop the electrical conductor and said electrical conductors are forming a bundle and composed of single metal 91 and multiple alloys 93. FIG. 9B is a cross sectional view of insulator of cable to envelop the electrical conductor, in which two electrical conductors are forming a bundle to be composed of single metal 91 and multiple metals or alloys 93, and another electrical conductor is composed of a single metal 91 and multiple metals or alloys 93. FIG. 9C is a cross sectional view of insulator of cable to envelop the electrical conductor, in which two electrical conductors are forming a bundle to be composed of single metal 91 and multiple metals or alloys 93, and another wire cable of electrical conductor is composed of multiple metals or alloys 93. FIG. 9D is a cross sectional view of insulator of cable to envelop the electrical conductor, in which two electrical conductors are forming a bundle to be composed of single metal and multiple metals or alloys, and another wire cable of electrical conductor is composed of single metal. FIG. 8E is a cross sectional view of insulator of cable to envelop the electrical conductor, in which two electrical conductors are forming a bundle to be composed of single metal, and another wire cable of electrical conductor is composed of single metal and multiple metals or alloys. FIG. 9F is cross sectional view of insulator of cable to envelop the electrical conductor, in which two electrical conductors are forming a bundle to be composed of multiple metals or alloys, and another wire cable of electrical conductor is composed of single metal and multiple metals or alloys. FIG. 9G is a cross sectional view of insulator of cable to envelop the electrical conductor, in which one electrical conductor is forming a bundle to be composed of single metal, the second wire cable of electrical conductor is composed of multiple metals or alloys and the third wire cable of electrical conductor is composed of single metal and multiple metals or alloys. FIG. 9H is a cross sectional view of insulator of cable to envelop the electrical conductor, in which each of electrical conductors is forming a bundle to be composed of multiple metals or alloys respectively. FIG. 9I is a cross sectional view of insulator of cable to envelop the electrical conductor, in which two electrical conductors are forming a bundle to be composed of multiple metals or alloys, and another electrical conductor is composed of a single metal.

FIG. 10 is cross sectional view of a wire cable of electrical conductor forming of multiple metals or alloys of the present invention. FIGS. 10A–10I are cross sectional views of three (separate) bundle wire cables in triangle order with insulator cover and the forming patterns are identical with those of in FIGS. 9A–9I.

FIG. 11 is cross sectional view of a wire cable of electrical conductor forming of multiple metals or alloys of the present invention. FIGS. 11A–11I are cross sectional views of three (combined) bundle wire cables to form triangle order and the forming patterns are identical with those of in FIGS. 9A–9I.

FIG. 12 is cross sectional view of a wire cable of electrical conductor forming of multiple metals or alloys of the present invention. FIGS. 12A–12I are cross sectional views of three (combined) bundle wire cables to form a linear order and the forming patterns are identical with those of in FIGS. 9A–9I.

Figure 1:
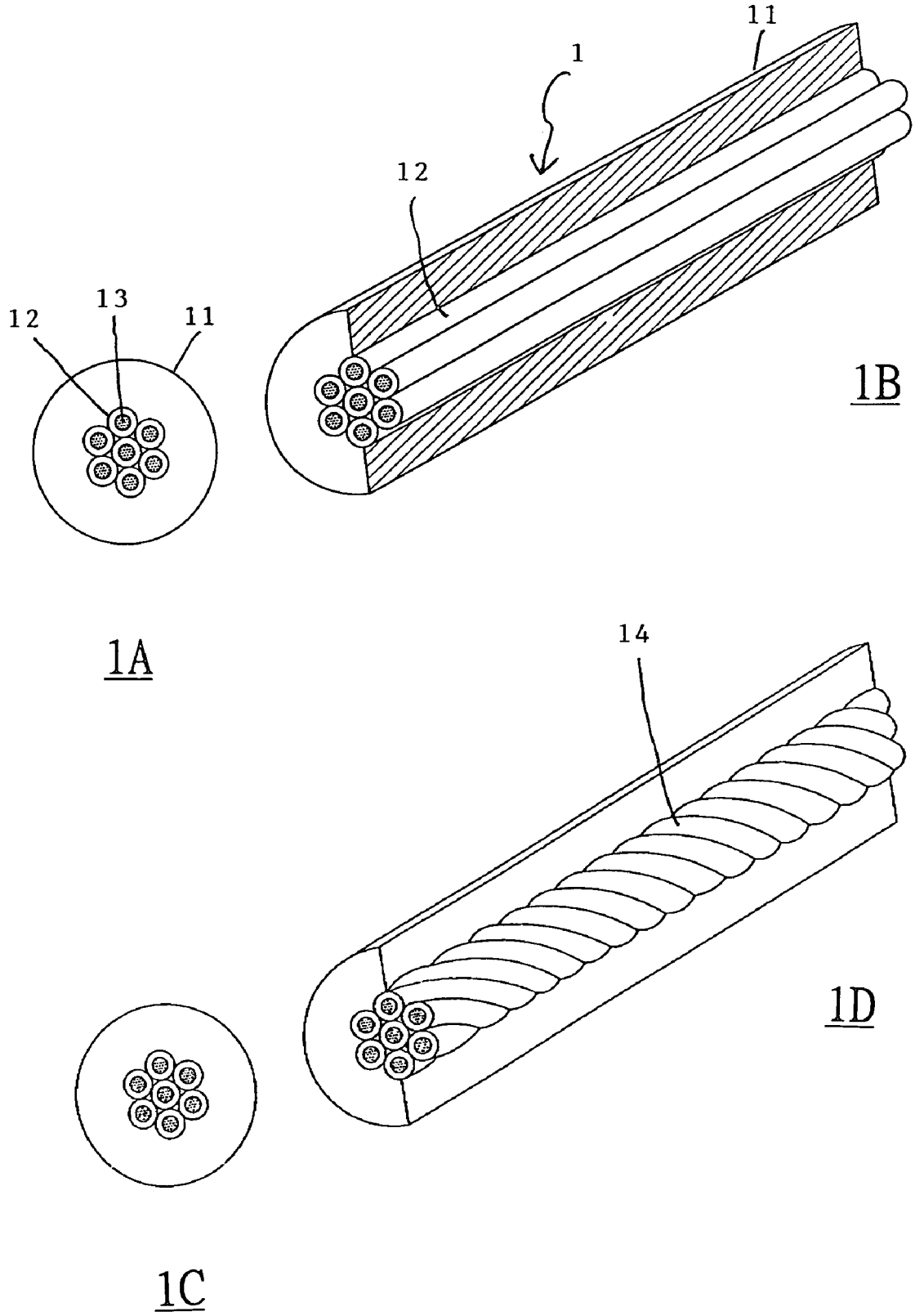
FIG. 1 is perspective view of a wire cable of electrical conductor forming of multiple metals or alloys of the present invention.
Figure 2:
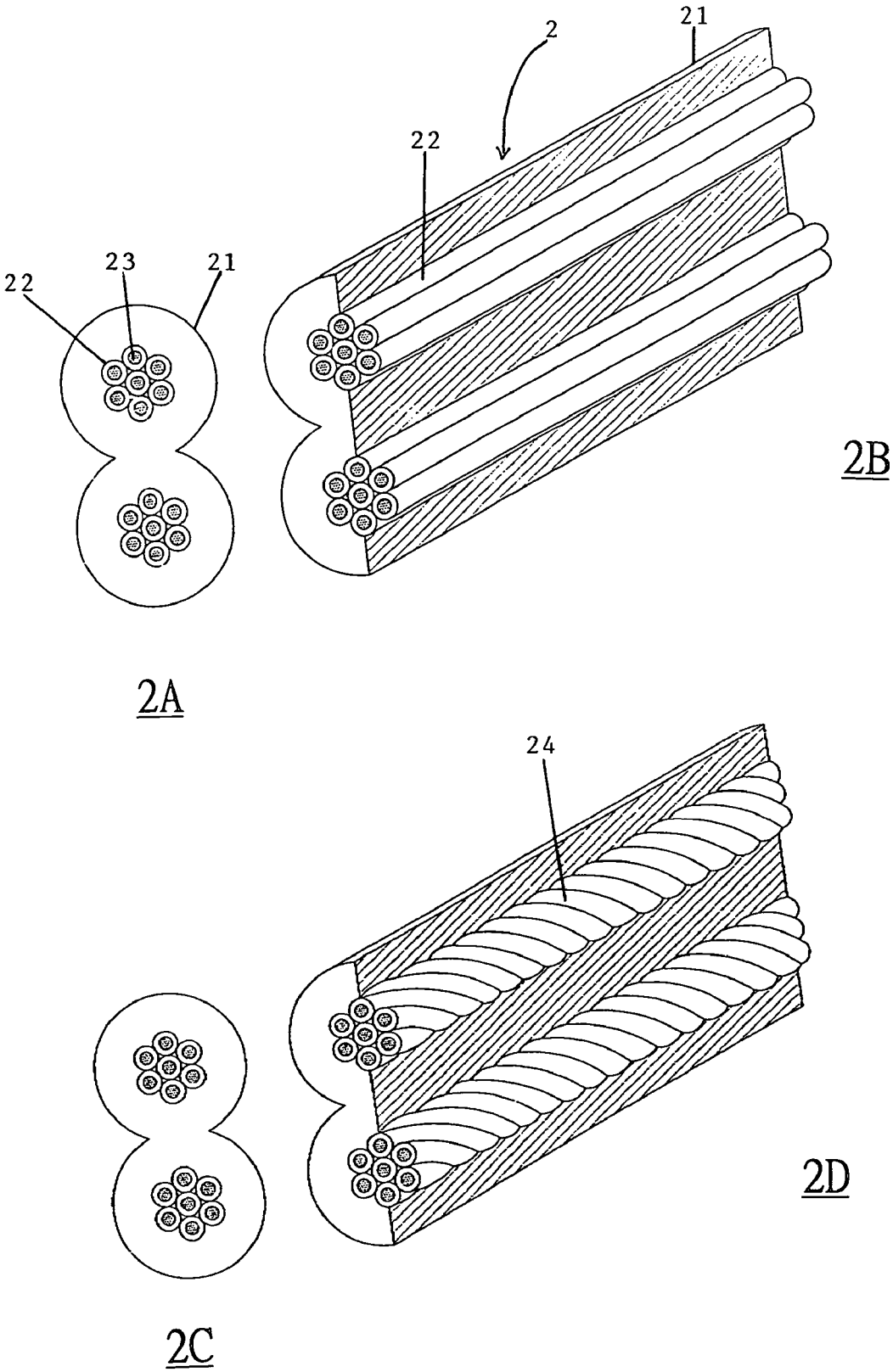
FIG. 2 is perspective view of double (twin) bundle wire cables of electrical conductor forming of multiple metals or alloys of the present invention.
Figure 3:
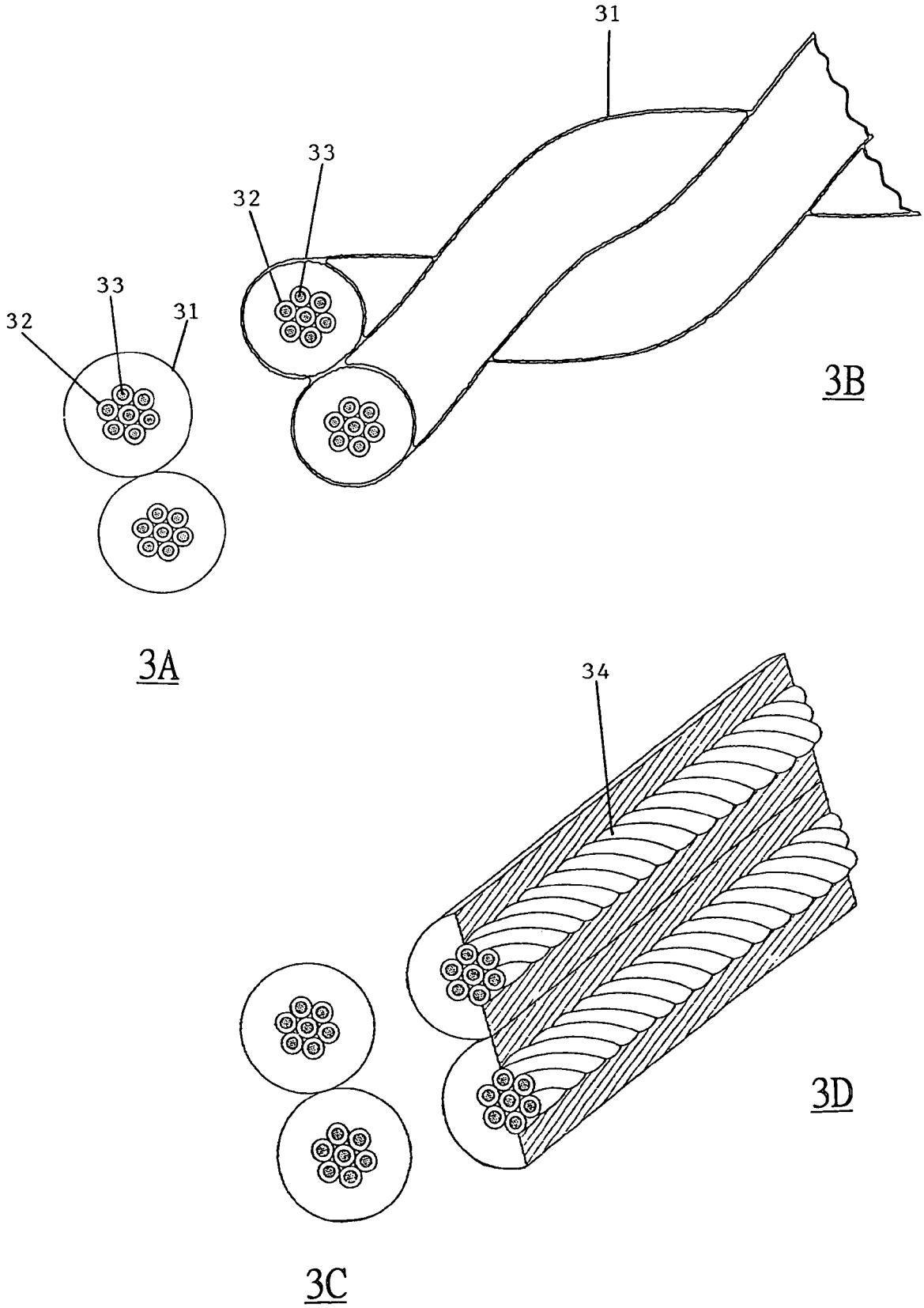
FIG. 3 is perspective view of two (separate) bundle wire cables of electrical conductor forming of multiple metals or alloys of the present invention.
Figure 4:
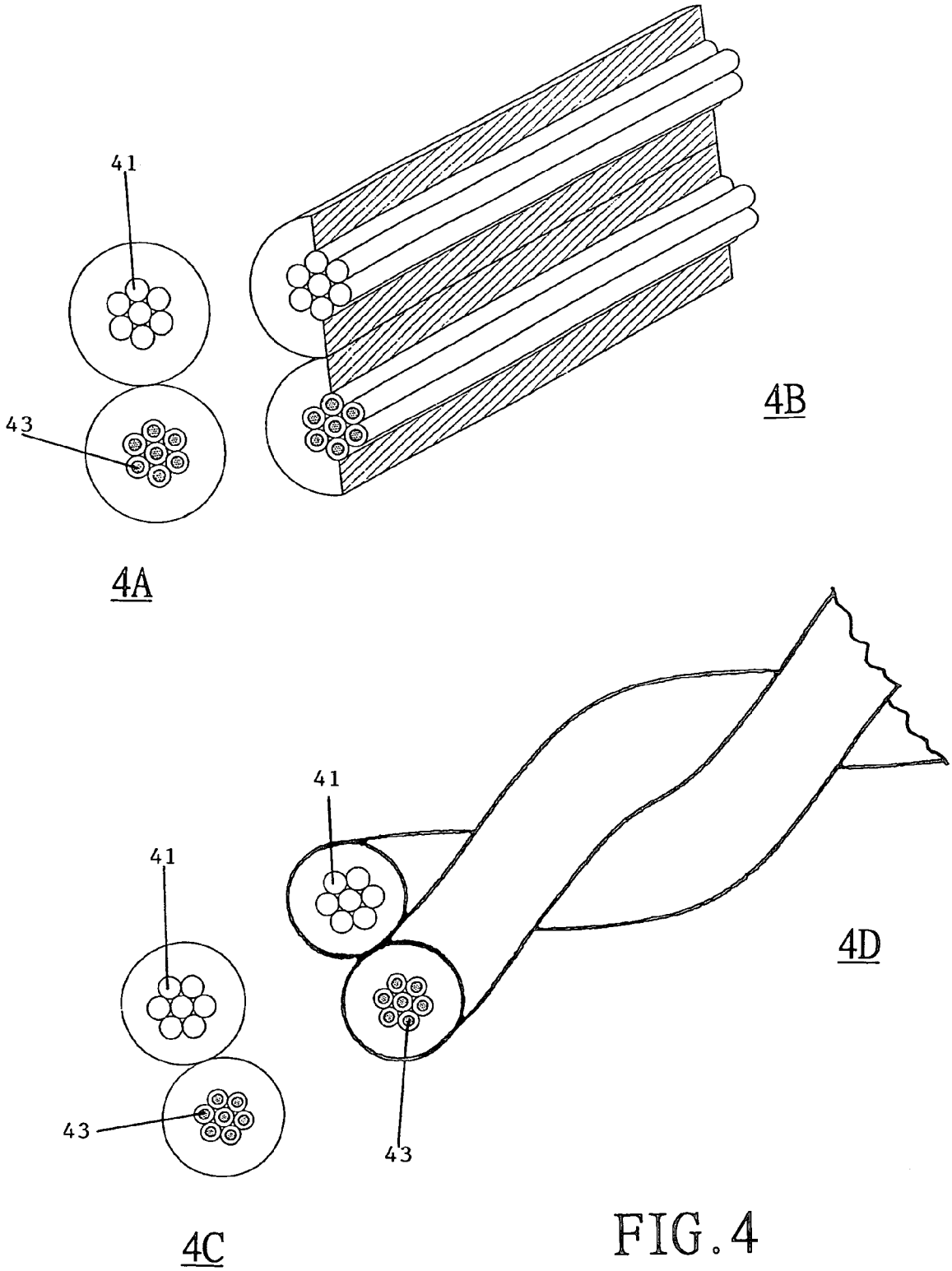
FIG. 4 is perspective view of two bundle wire cables of electrical conductor forming of multiple metals or alloys of the present invention.
Figure 5:
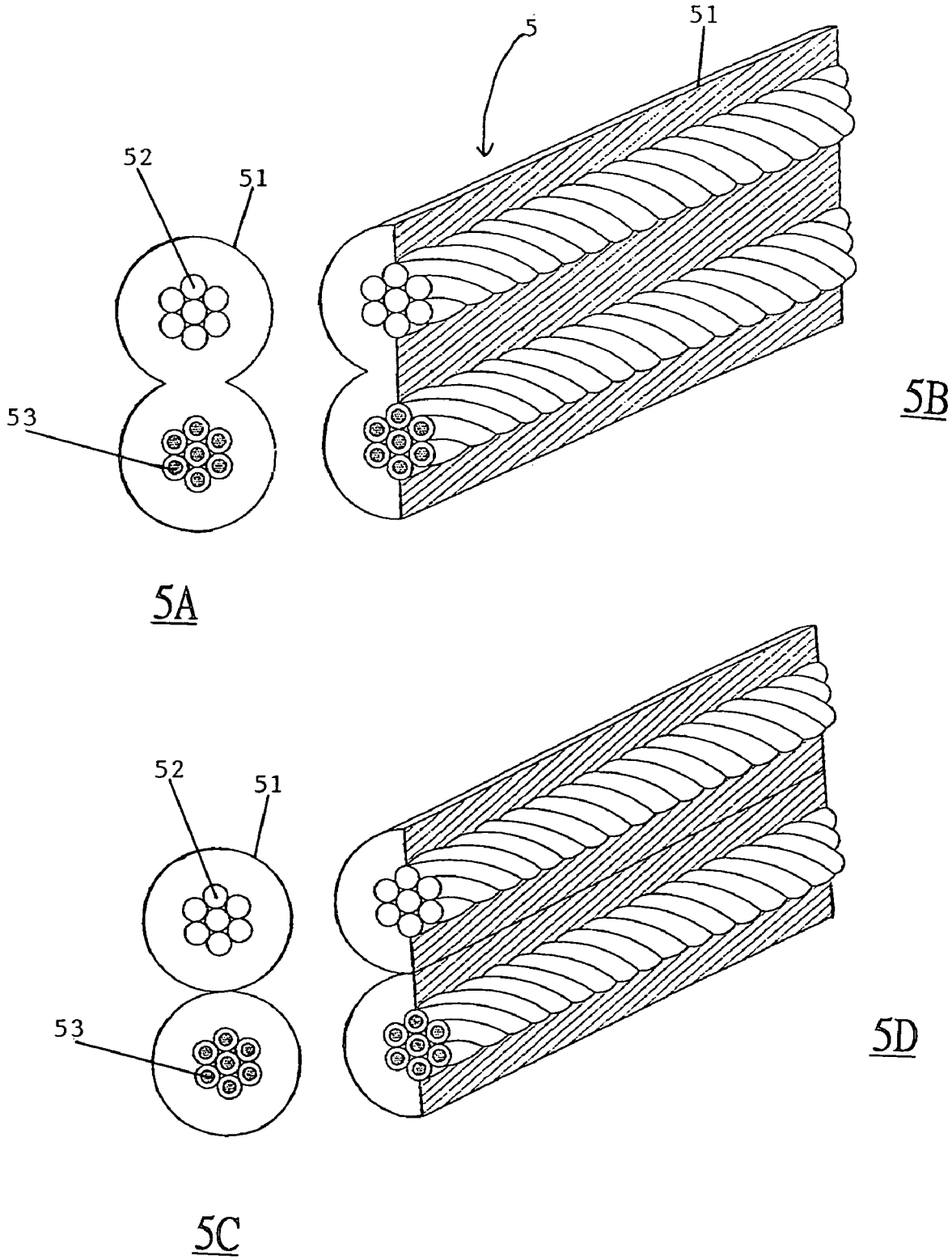
FIG. 5 is perspective view of double bundle wire cables of electrical conductor forming of multiple metals or alloys of the present invention.
Figure 6:
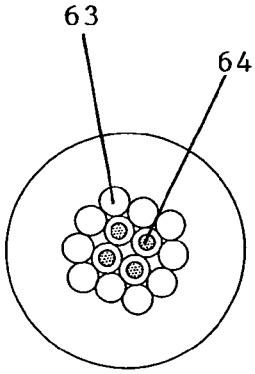
FIG. 6 is perspective view of single (bundle) wire cable of electrical conductor forming of multiple metals or alloys of the present invention.
Figure 6:
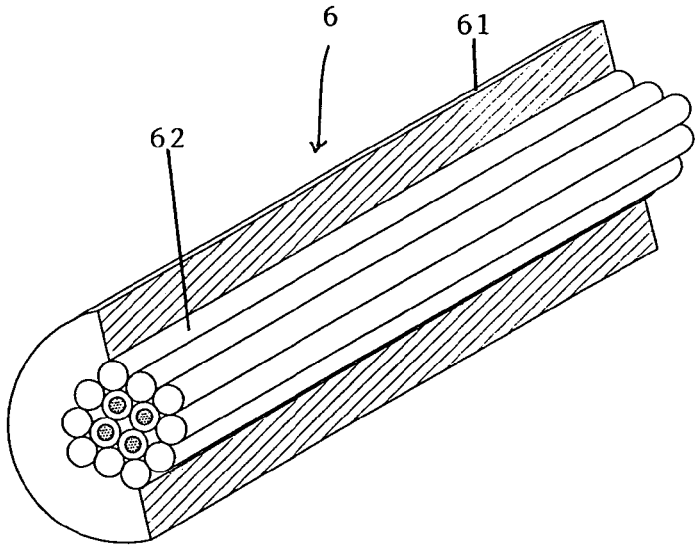
Figure 6:
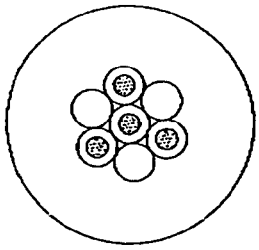
Figure 6:
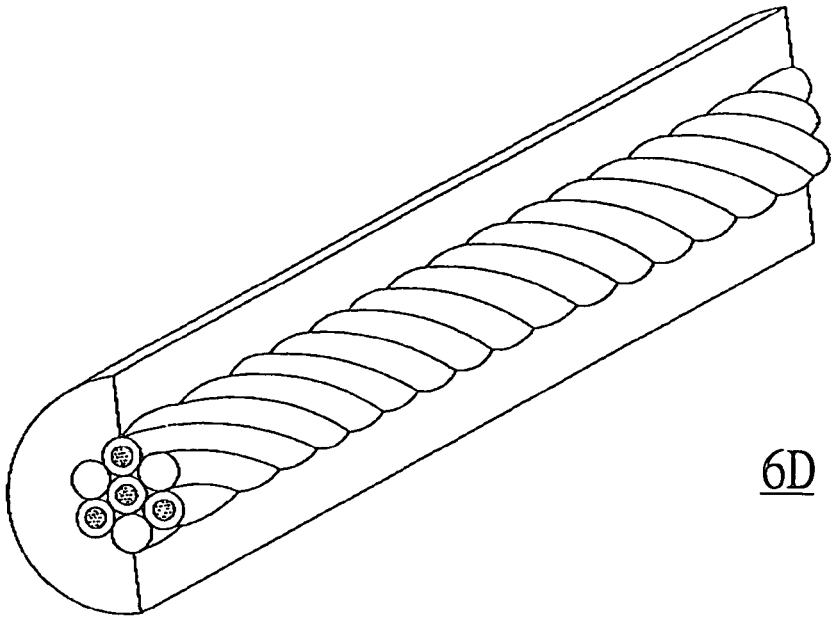
Figure 7:
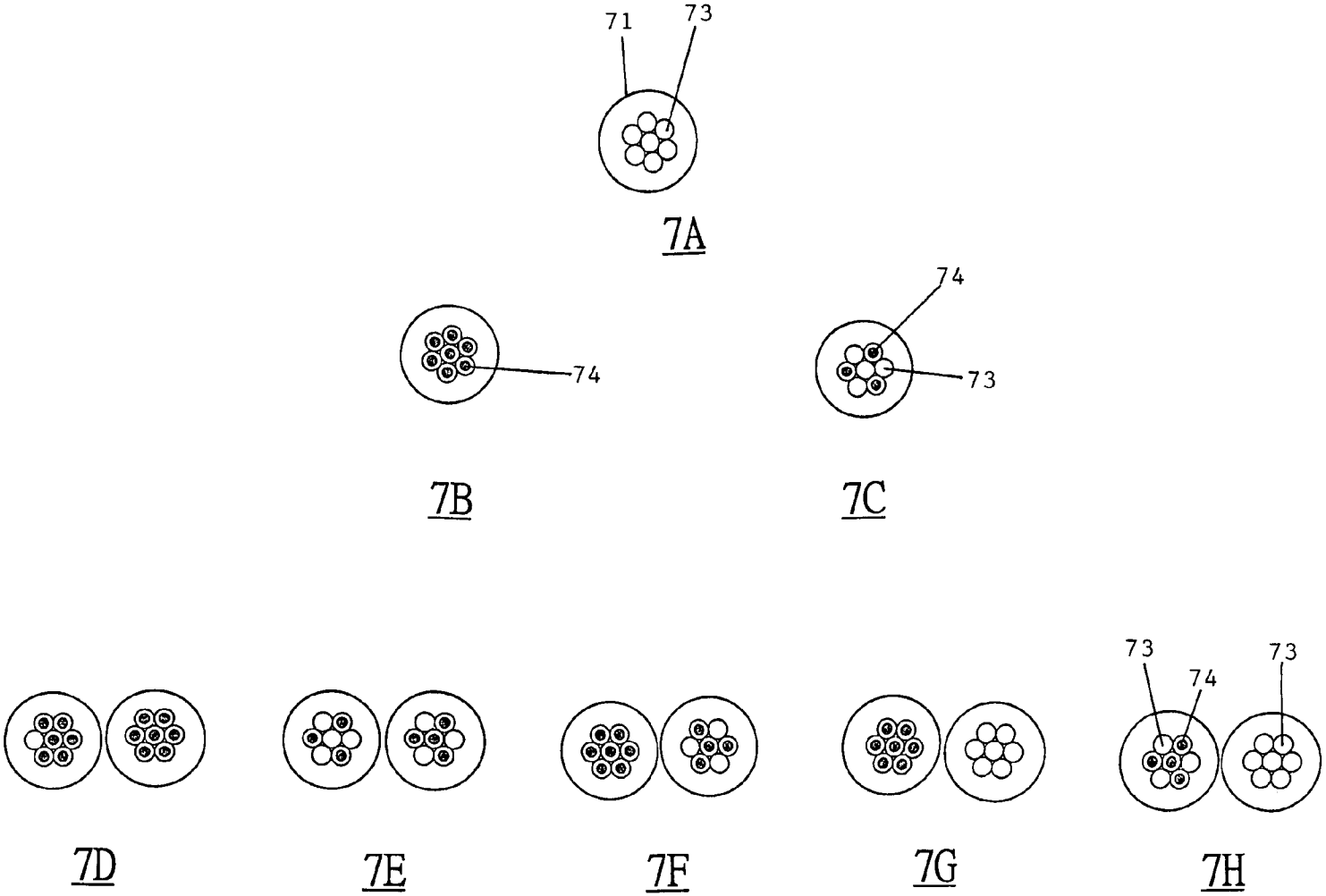
FIG. 7 is cross sectional view of wire cable(s) of electrical conductor forming of multiple metals or alloys of the present invention.
Figure 8:
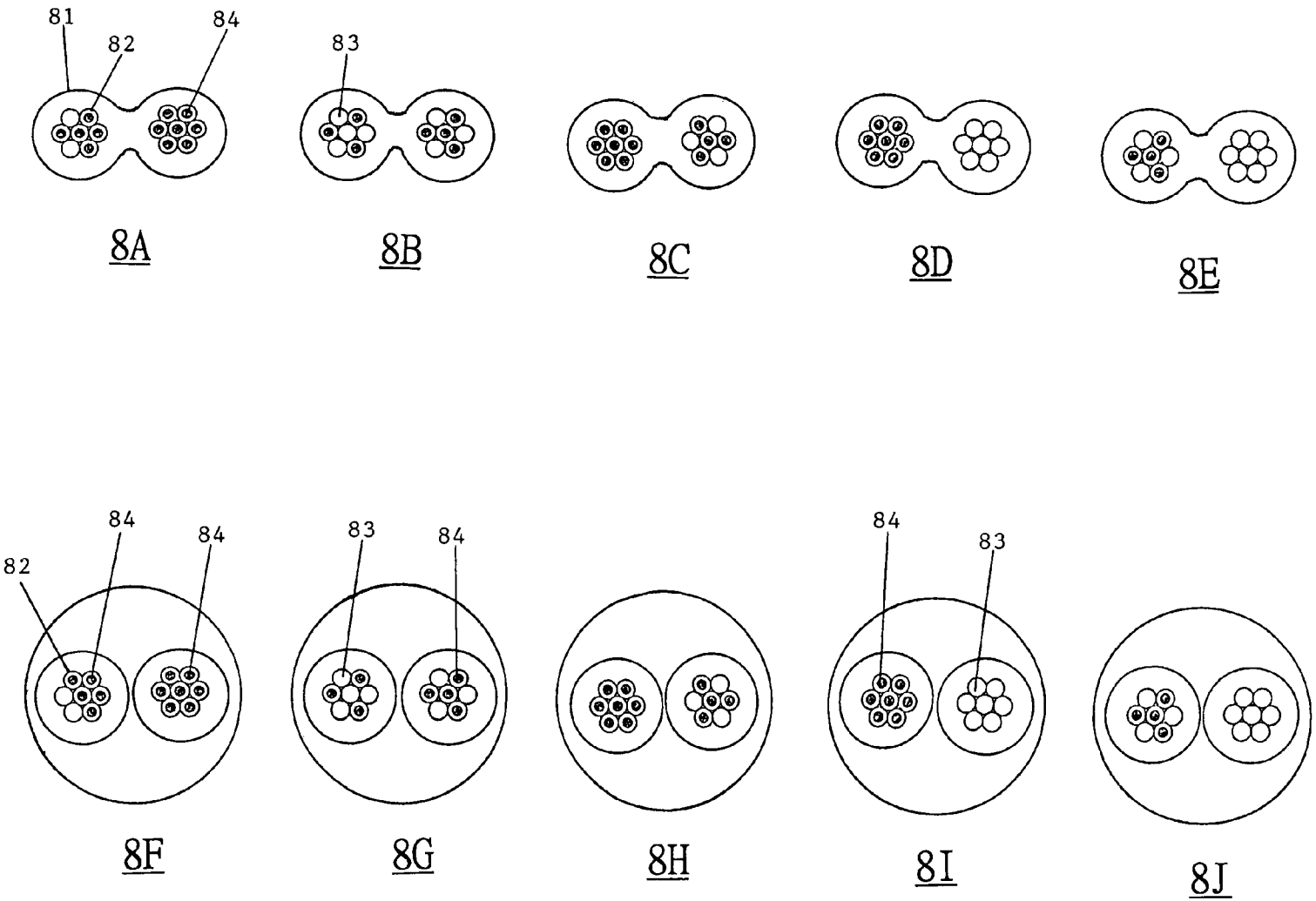
FIG. 8 is cross sectional view of wire cables of electrical conductors forming of multiple metals or alloys of the present invention.
Figure 9:
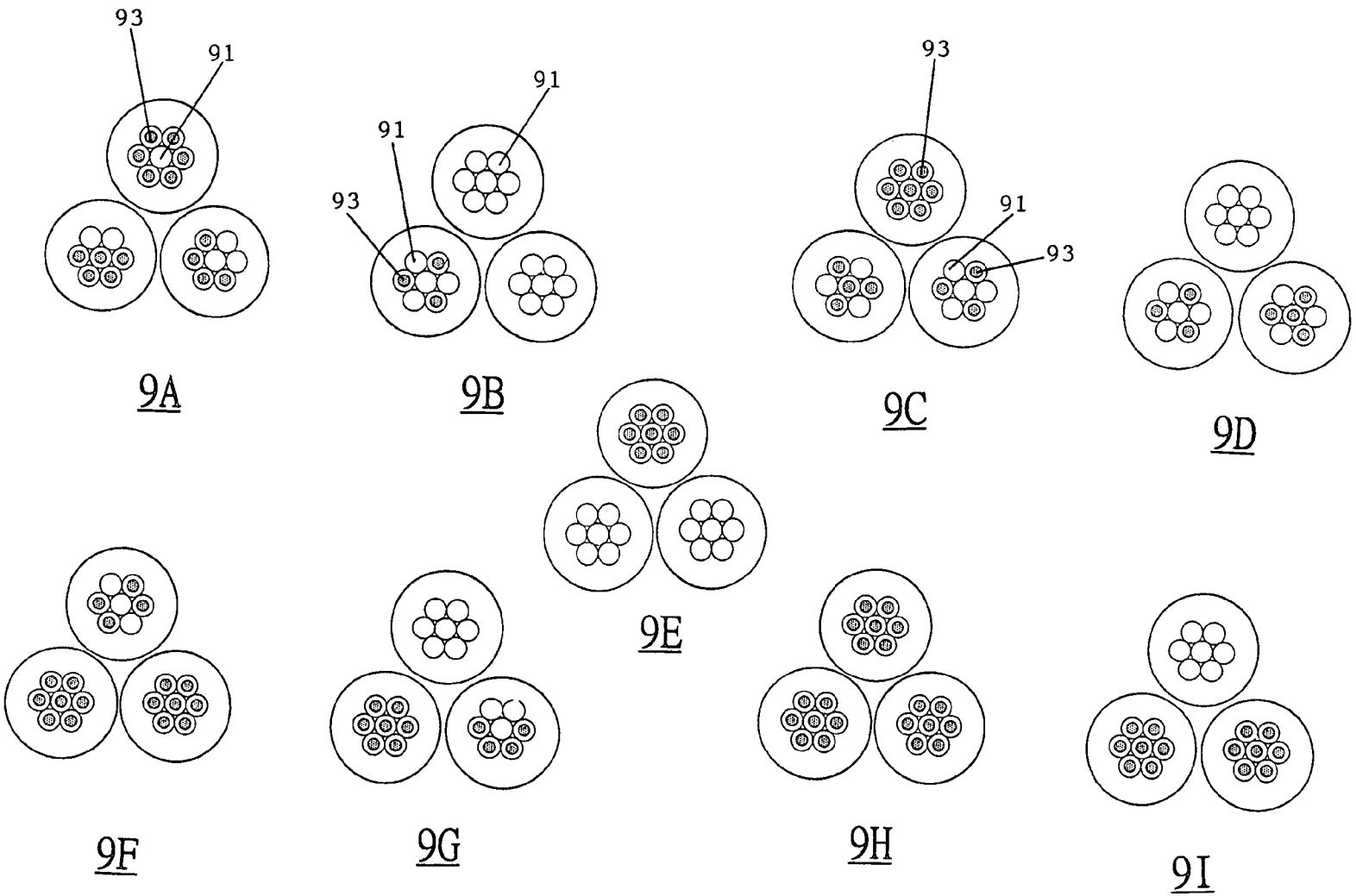
FIG. 9 is cross sectional view of three bundle wire cables of electrical conductor forming of multiple metals or alloys of the present invention.
Figure 10:
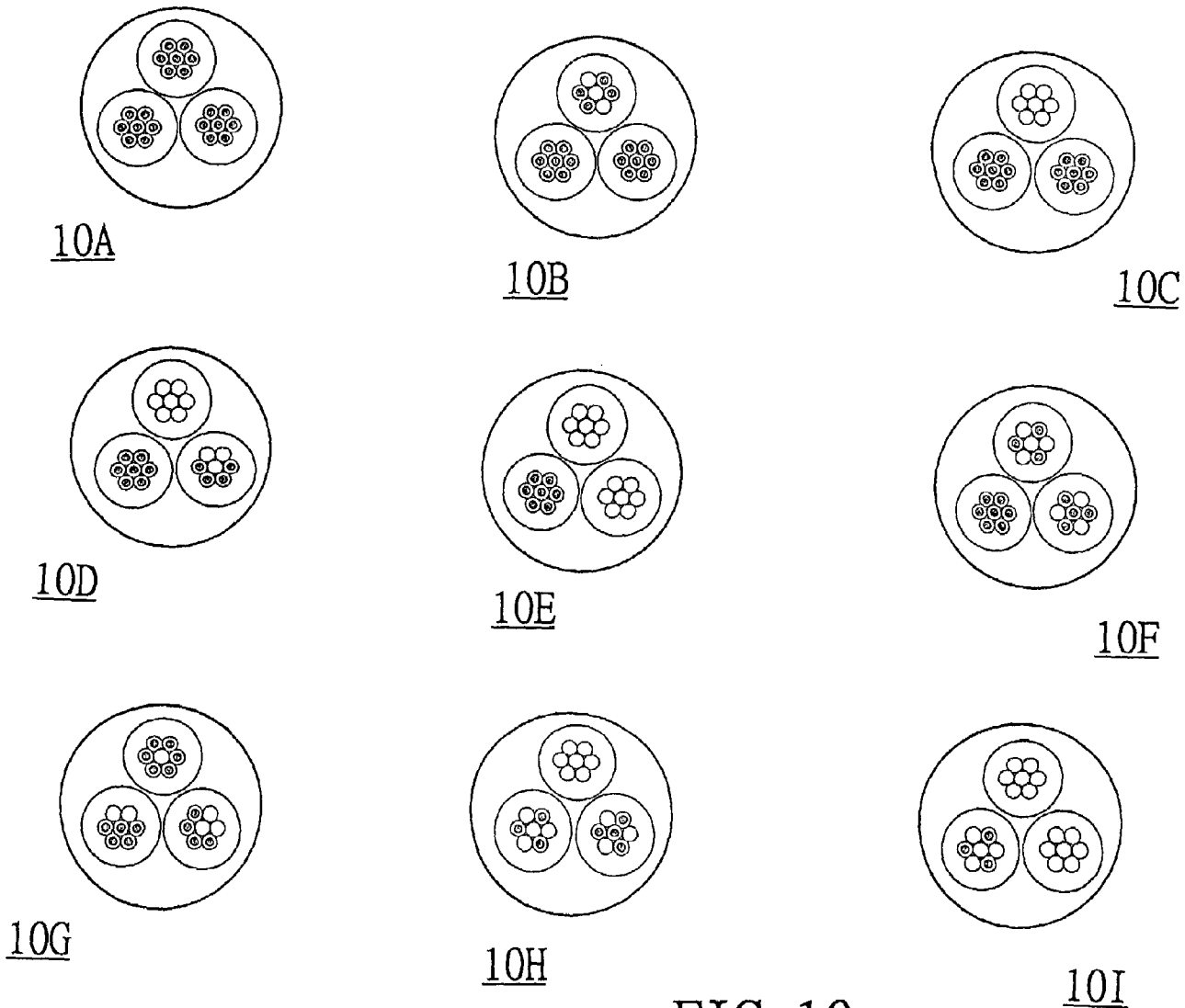
FIG. 10 is cross sectional view of three bundle wire cables of electrical conductor forming of multiple metals or alloys of the present invention.
Figure 11:
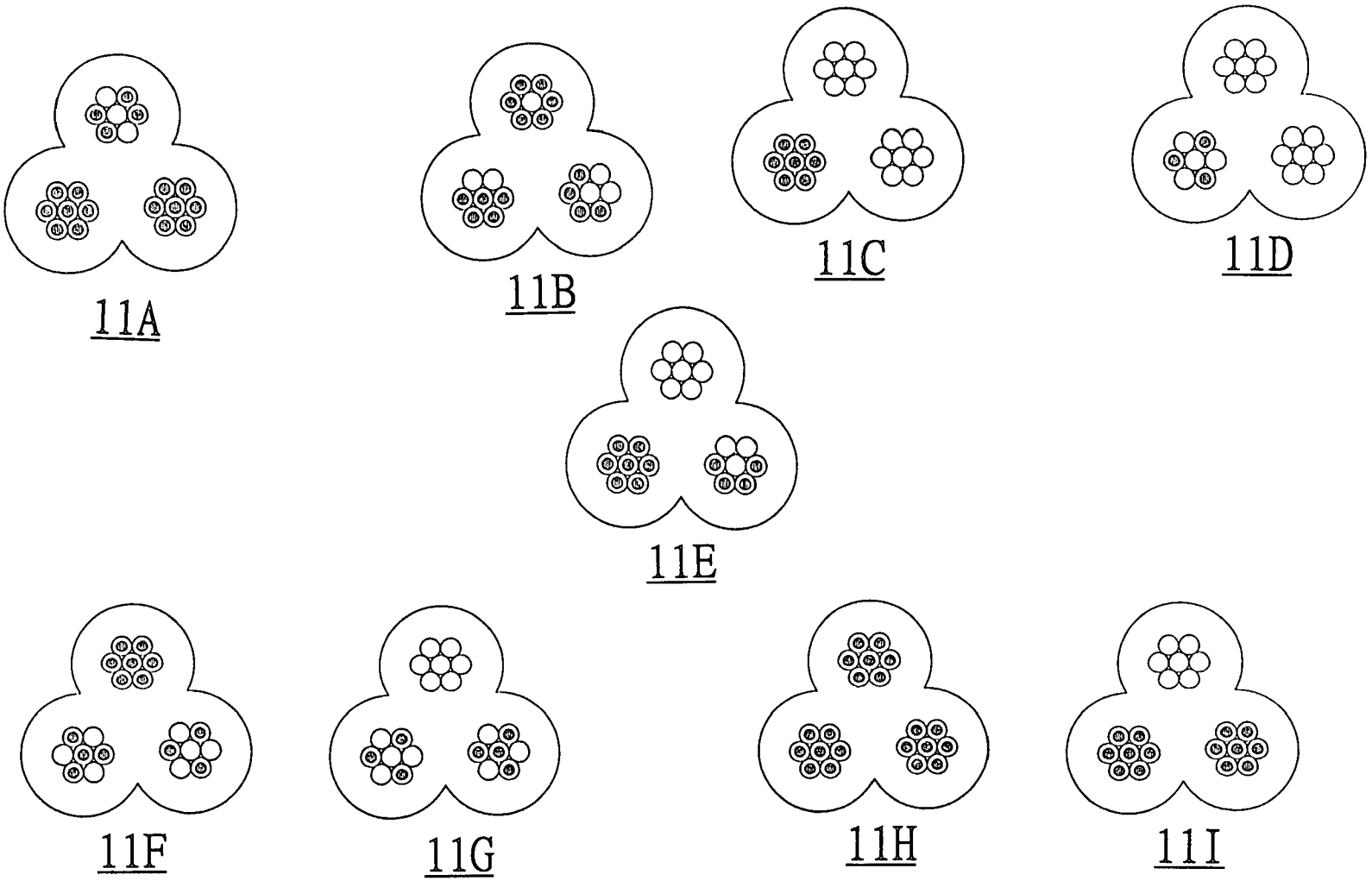
FIG. 11 is cross sectional view of three (combined) bundle wire cables of electrical conductor forming of multiple metals or alloys of the present invention.
Figure 12:
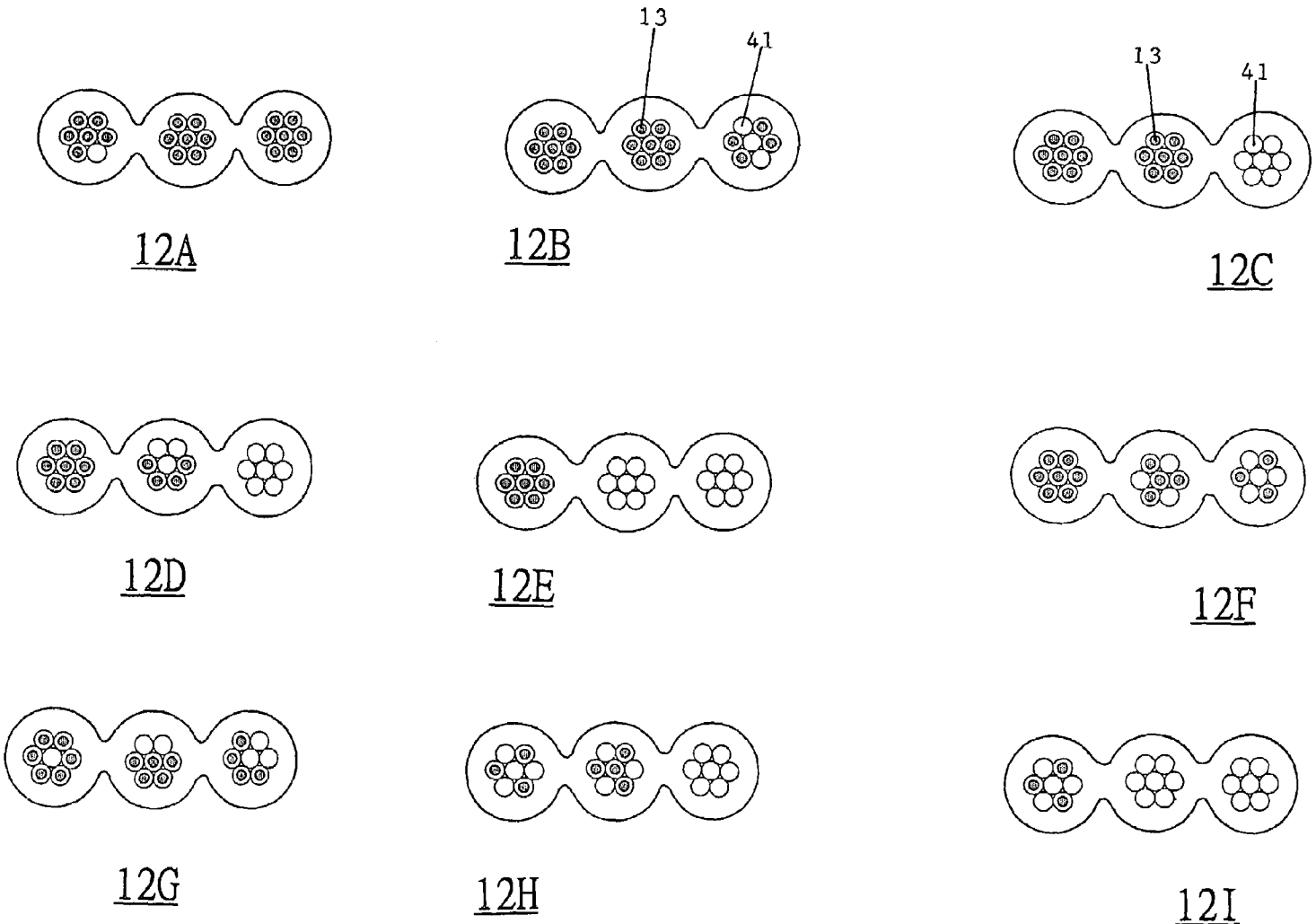
FIG. 12 is cross sectional view of three (combined) bundle wire cables of electrical conductor forming of multiple metals or alloys of the present invention.

From the foregoing it will be appreciated that although the specific embodiments of the invention have been described herein for purposed of illustration, various modifications and improvements thereon will become readily apparent to those skilled in the art. Accordingly, the appended claims are to be construed broadly and in a manner consistent with the spirit and scope of the invention described herein.

What is claimed is:

1. A wire cable of electrical conductors formed of multiple metals or alloys, the wire cable comprising:

a double bundle wire cable, including at least two bundles of electrical conductors, one bundle of said bundles of electrical conductors comprising a plurality of slim electric wires made by two or more metals or two or more single distinct alloys and at least one slim electric wire made by a single metal or a single distinct alloy, another bundle of said electrical conductors comprising a plurality of slim electric wires made by a single metal or a single distinct alloy, wherein said two bundles of electrical conductors are covered by an insulator to form the wire cable of electrical conductor and each bundle in said double wire cable includes a single wire cable covered to form a cable wire.

2. A wire cable of electrical conductors formed of multiple metals or alloys as claimed in claim 1, wherein each said slim electric wire made by two or more metals or two or more single distinct alloys includes one metal or a single distinct alloy being contained within another metal or alloy.

3. A wire cable of electrical conductors formed of multiple metals or alloys as claimed in claim 1, wherein said plurality of slim electric wires are parallel to each other.

4. A wire cable of electrical conductors formed of multiple metals or alloys as claimed in claim 1, wherein said plurality of slim electric wires are wound to form said bundle.

5. A wire cable of electrical conductors formed of multiple metals or alloys as claimed in claim 1, wherein a plurality of said single wire cables are wound into a large wire cable.

6. A wire cable of electrical conductors formed of multiple metals or alloys as claimed in claim 5, wherein an outer layer of insulator encircles said plurality of single wire cables to be wound into said large wire cable.

7. A wire cable of electrical conductors formed of multiple metals or alloys as claimed in claim 1, wherein each said bundle is covered by an outer insulator and said outer insulator is pressed out in one motion to form altogether said wire cable.

8. A wire cable of electrical conductors formed of multiple metals or alloys, the wire cable comprising:

at least two bundle wire cables including two bundles of electrical conductors, one bundle of said electrical conductors comprising a plurality of slim electric wires made by two or more metals or two or more single distinct alloys, another bundle of said electrical conductors comprising a plurality of slim electric wires made by a combination of two or more metals or two or more single distinct alloys and at least a slim electric wire made by a single metal or a single distinct alloy, wherein said two bundles of electrical conductors are covered by an insulator to form said wire cable of electrical conductor and each bundle, in said at least two bundle wire cables, includes a single wire cable covered to form a cable wire.

9. A wire cable of electrical conductors formed of multiple metals or alloys as claimed in claim 8, wherein each said slim electric wire made by two or more metals or two or more single distinct alloys includes one metal or a single distinct alloy being contained within another metal or distinct alloy.

10. A wire cable of electrical conductors formed of multiple metals or alloys as claimed in claim 8, wherein said plurality of slim electric wires are parallel to each other.

11. A wire cable of electrical conductors formed of multiple metals or alloys as claimed in claim 8, wherein said plurality of slim electric wires are wound to form said bundle.

12. A wire cable of electrical conductors formed of multiple metals or alloys as claimed in claim 8, wherein a plurality of said single wire cables are wound into a large wire cable.

13. A wire cable of electrical conductors formed of multiple metals or alloys as claimed in claim 12, wherein an outer layer of insulator encircles said plurality of single wire cables to be wound into said large wire cables.

14. A wire cable of electrical conductors formed of multiple metals or alloys as claimed in claim 8, wherein each said bundle is covered by an outer insulator and said outer insulator is pressed out in one motion to form altogether said wire cable.

15. A wire cable of electrical conductors formed of multiple metals or alloys , the wire cable comprising:

three kinds of single bundle wire cables with a bundle in each cable or more than three bundle wire cables with at least three bundles in each cable, said wire cable including a first, a second and a third bundle of electrical conductors, said first bundle of said electrical conductors further comprising a plurality of slim electric wires made by two or more metals or two or mare single distinct alloys, and said second bundle of electrical conductors further comprising a combination of a plurality of slim electric wires made by two metals or two or more single distinct alloys and a plurality of slim electric wires made by a single metal or a single distinct alloy, and said third bundle of said electrical conductors comprising a plurality of slim electric wires made by a single metal or a single distinct alloy, wherein said first, second, and third bundles are covered by an insulator to form the wire cable of electrical conductor.

16. A wire cable of electrical conductors formed of multiple metals or alloys as claimed in claim 15, wherein each said slim electric wire made by two or more metals or two or more single distinct alloys includes one metal or a single distinct alloy being contained within another metal or distinct alloy.

17. A wire cable of electrical conductors formed of multiple metals or alloys as claimed in claim 15, wherein said plurality of slim electric wires are parallel to each other.

18. A wire cable of electrical conductors formed of multiple metals or alloys as claimed in claim 15, wherein said plurality of slim electric wires are wound to form said bundle.

19. A wire cable of electrical conductors formed of multiple metals or alloys as claimed in claim 15, wherein each bundle includes a single wire cable covered to form a cable wire.

20. A wire cable of electrical conductors formed of multiple metals or alloys as claimed in claim 19, wherein a plurality of said single wire cables are wound into a large wire cable.

21. A wire cable of electrical conductors formed of multiple metals or alloys as claimed in claim 20, wherein an outer layer of insulator encircles said plurality of single wire cables to be wound into said large wire cable.

22. A wire cable of electrical conductors formed of multiple metals or alloys as claimed in claim 15, wherein each said bundle wire cable is covered by an outer insulator and said outer insulator is pressed out in one motion to form altogether said wire cable.

* * * * *